US007538728B1

(12) United States Patent
Chang et al.

(10) Patent No.: US 7,538,728 B1
(45) Date of Patent: May 26, 2009

(54) ANTENNA AND RESONANT FREQUENCY TUNING METHOD THEREOF

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 55 days.

(21) Appl. No.: 11/950,360

(22) Filed: Dec. 4, 2007

(51) Int. Cl.
*H01Q 9/04* (2006.01)
*H01Q 5/00* (2006.01)

(52) U.S. Cl. ..... 343/700 MS; 343/911 R

(58) Field of Classification Search ..... 343/700 MS, 343/911 R
See application file for complete search history.

(56) References Cited

U.S. PATENT DOCUMENTS 4,054,875 A * 10/1977 Cachier ..... 343/701
4,918,570 A * 4/1990 Okamura et al. ..... 361/321.2
5,617,104 A * 4/1997 Das ..... 343/700 MS
5,952,972 A * 9/1999 Ittipiboon et al. ..... 343/700 MS
6,292,141 B1 * 9/2001 Lim ..... 343/700 MS
6,426,725 B2 * 7/2002 Hiroshima et al. ..... 343/741
6,556,169 B1 * 4/2003 Fukuura et al. ..... 343/700 MS
7,292,204 B1 * 11/2007 Chang et al. ..... 343/909
2007/0152884 A1 * 7/2007 Bouche et al. ..... 343/700 MS

OTHER PUBLICATIONS

Tze-Hsuan Chang and Jean-Fu Kiang, "Dualband Split Dielectric Resonator Antenna", IEEE Transactions on Antennas and Propagation, Nov. 2007, pp. 3151-3162, vol. 55, No. 11, IEEE.

* cited by examiner

*Primary Examiner*—Vibol Tan
*Assistant Examiner*—Jason Crawford
(74) *Attorney, Agent, or Firm*—WPAT, P.C.; Justin King

(57) ABSTRACT

A dual-band dielectric resonator antenna (DRA) is designed by splitting a rectilinear DR and carving notches and tunnels off the DR. The antenna comprises a substrate, a microstrip line, a ground plane and a resonant structure, wherein a first resonant part and a second resonant part of the resonant structure are separated by a gap. The proposed DRA can cover both the WiMAX (3.4-3.7 GHz) and the WLAN (5.15-5.35 GHz) bands by engraving notches and tunnels at different positions of the first resonant part and the second resonant part.

24 Claims, 13 Drawing Sheets

ANTENNA AND RESONANT FREQUENCY TUNING METHOD THEREOF

BACKGROUND OF THE INVENTION

1. Field of the Invention

The present invention generally relates to an antenna and bandwidth increasing and resonant frequently tuning method thereof.

2. Description of the Prior Art

Dielectric resonators made of low-loss and high-permittivity material have been used to implement antenna. They have higher radiation efficiency than printed antennas at higher frequency due to the absence of ohmic loss and surface wave, in addition to compact size, light weight, and low cost.

Many efforts have been devoted to developing multi-band or wideband DRAs. For example, make the feeding aperture radiate like a slot antenna to incur another band, induce parasitic effects with attached metal strips.

In [C. S. D. Young and S. A. Long, "Investigation of dual mode wideband rectangular and cylindrical dielectric resonator antennas," *IEEE APS Int. Symp.,* vol. 4, pp. 210-213, July 2005.], specific higher-order modes with the electric field distribution on the top surface of the DR similar to that of the fundamental mode are intentionally excited. In [A. A. Kishk, "Wide-band truncated tetrahedron dielectric resonator antenna excited by a coaxial probe," *IEEE Trans. Antennas Propag.,* vol. 51, no. 10, pp. 2913-2917, October 2003.] and [A. A. Kishk, Y. Yin, and A. W. Glisson, "Conical dielectric resonator antennas for wide-band applications," *IEEE Trans. Antennas Propag.,* vol. 50, no. 5, pp. 469-474, April 2002.], higher-order modes of truncated conical or tetrahedral DR are excited to obtain wide impedance bandwidth.

DRs of different sizes have been placed vertically to form a stacked DRA, or at close proximity to form a multi-element DRA to attain wideband or dual-band features.

SUMMARY OF THE INVENTION

Therefore, in accordance with the previous summary, objects, features and advantages of the present disclosure will become apparent to one skilled in the art from the subsequent description and the appended claims taken in conjunction with the accompanying drawings.

An antenna and resonant frequency tuning method thereof are disclosed. The antenna comprises a substrate, a microstrip line, a ground plane and a resonator structure. The microstrip line and the ground plane are formed on the opposite surfaces of the substrate, and the ground plane comprises an aperture. The resonator structure is placed on the ground plane, and a first resonator and a second resonator of the resonator structure are separated by a gap, wherein the first resonator comprises a first bottom surface and a first side surface, and the second resonator comprises a second bottom surface and a second side surface. The resonant frequency of the $TE_{111}^{y}$ mode of the antenna can be tuned by adjusting the width of the gap, and the bandwidth can be increased by increasing the width of the gap.

A first tunnel is engraved at the corner where the gap and the first bottom surface meet, and a second tunnel is engraved at the corner where the gap and the second bottom surface meet, wherein the resonant frequency of the $T_{112}^{y}$ mode of the antenna can be tuned by adjusting the dimensions and the positions of the first and second tunnel. Moreover, a first notch is engraved at the first side surface, and a second notch is engraved at the second side surface, wherein the bandwidth of the $TE_{111}^{y}$, $TE_{112}^{y}$ and $TE_{113}^{y}$ modes of the antenna can be increased by adjusting the dimensions and the positions of the first and second notch. Signals can be transmitted via the microstrip line, the aperture and the resonator structure in turn.

BRIEF DESCRIPTION OF THE DRAWINGS

The accompanying drawings incorporated in and forming a part of the specification illustrate several aspects of the present invention, and together with the description serve to explain the principles of the disclosure. In the drawings.

DETAILED DESCRIPTION OF THE PREFERRED EMBODIMENTS

Figure 1A:
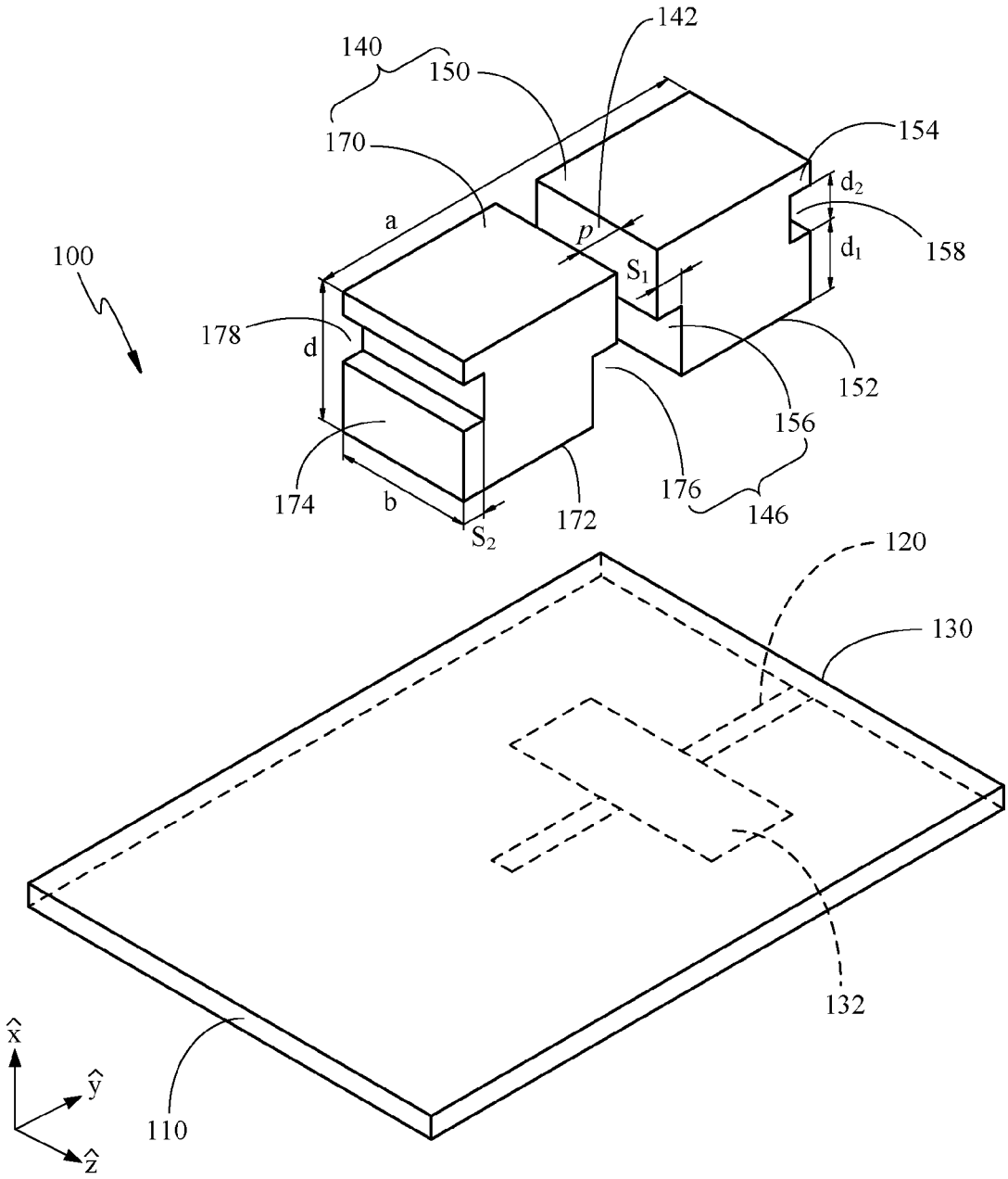
FIG. 1A, FIG. 1B, FIG. 1C, FIG. 2, FIG. 3A, FIG. 3B, FIG. 3C, FIG. 4A, FIG. 4B, FIG. 6A, FIG. 6B, FIG. 8A, FIG. 8B, FIG. 11A, and FIG. 11B are diagrams illustrate the structure of an antenna.

The present disclosure can be described by the embodiments given below. It is understood, however, that the embodiments below are not necessarily limitations to the present disclosure, but are used to a typical implementation of the invention.

Having summarized various aspects of the present invention, reference will now be made in detail to the description of the invention as illustrated in the drawings. While the invention will be described in connection with these drawings, there is no intent to limit it to the embodiment or embodiments disclosed therein. On the contrary the intent is to cover all alternatives, modifications and equivalents included within the spirit and scope of the invention as defined by the appended claims.

It is noted that the drawings presented herein have been provided to illustrate certain features and aspects of embodiments of the invention. It will be appreciated from the description provided herein that a variety of alternative embodiments and implementations may be realized, consistent with the scope and spirit of the present invention.

It is also noted that the drawings presented herein are not consistent with the same scale. Some scales of some components are not proportional to the scales of other components in order to provide comprehensive descriptions and emphases to this present invention.

In this invention, a dual-band DRA (Dielectric Resonator Antenna) is proposed by splitting a rectilinear DR evenly. The electric field over the gap in between is significantly enhanced, hence reducing the Q-factor. Two notches are also engraved in each piece to tune the resonant frequencies and increase the impedance bandwidth as well. The effect of the gap and notches on the resonant frequencies are carefully disclosed, and the resonant bands associated with the $TE_{111}^{y}$ and $TE_{113}^{y}$ modes can be adjusted to cover the WiMAX (3.3-3.7 GHz) and the WLAN (5.15-5.35 GHz) bands.

Figure 1B:
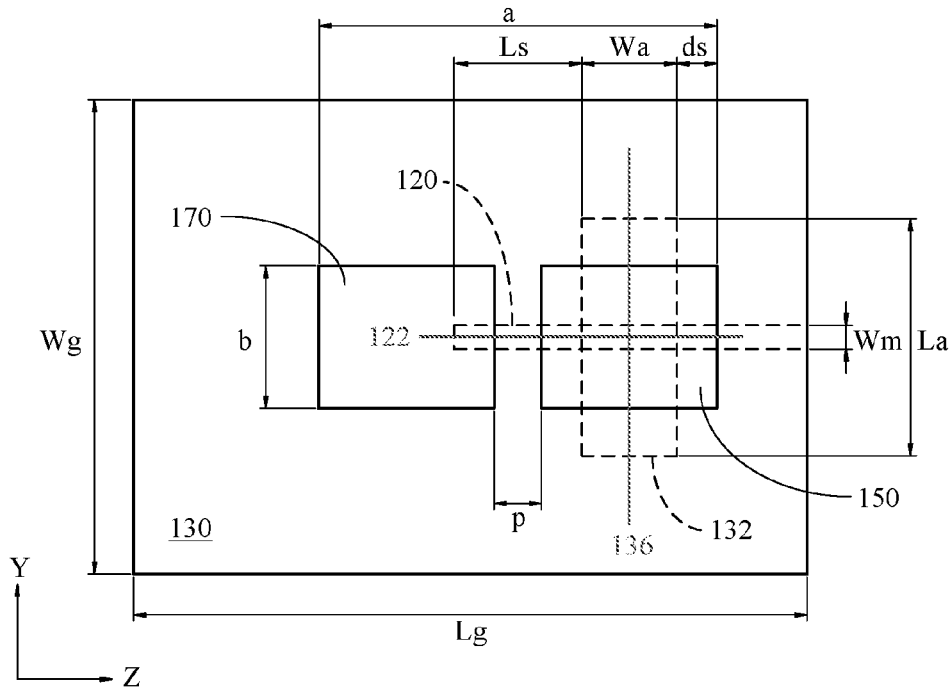

FIG. 1A and FIG. 1B show the configuration of an antenna 100, which is composed of two identical rectangular resonators, a first resonator 150 and a second resonator 170, of dimension a×b×d, separated by a gap p. The antenna 100 can be a DRA, and each resonator (or DR) is engraved with two notches at its bottom and side edge, wherein a first tunnel 156 and a second tunnel 176 with dimensions $s_1 \times b \times d_1$ are respectively located at bottoms of the first resonator 150 and the second resonator 170, and a first notch 158 and a second notch 178 with dimensions $s_2 \times b \times d_2$ are respectively located at side edges of the first resonator 150 and the second resonator 170. The resonators 150, 170 are placed on a ground plane 130 of size $W_g \times L_g$ on an FR4 substrate of thickness t and permittivity 4.4. A microstrip line 120 is used to feed the resonators through an aperture 132 of size $L_a \times W_a$. The microstrip line 120 is extended over the aperture 132 by $L_s$. The offset between the aperture 132 and the first resonator 150 is $d_s$.

The resonant frequency is mainly determined by the dimensions a, b, d and permittivity $\epsilon_0\epsilon_r$ of the resonators 150, 170. The carved notches change the electric field distribution in the original resonators 150, 170, hence the resonant frequencies. Since the gap 142 is perpendicular to the electric field of the $TE_{111}{}^y$ mode of the otherwise intact resonators 150, 170, the electric field is enhanced within the gap 142. Thus, the resonant frequency of the $TE_{111}{}^y$ mode and impedance are significantly affected. The input impedance can be fine tuned by adjusting the resonator offset $d_s$, the length of the extended microstrip line 120, and the aperture 132 length $L_a$.

The electric field $\overline{E}_0$ and the magnetic field $\overline{H}_0$ in a dielectric resonator taking the space V satisfy the Maxwell's equations $$-\nabla\times\overline{E}_0=j\omega_0\mu\overline{H}_0 \tag{1}$$

$$\nabla\times\overline{H}_0=j\omega_0\epsilon\overline{E}_0 \tag{2}$$

where $\omega_0$ is the resonant frequency. When the shape of dielectric resonator is modified by engraving gap 142, tunnels 156, 176, and notches 158, 178, the dielectric constant in the space V becomes a function of location $\epsilon'(\overline{r})$, the field distributions and the resonant frequency become $\overline{E}$, $\overline{H}$ and $\omega$, respectively, satisfying the Maxwell's equations as well. Applying the reaction operation between the original field and the perturbed field, the resonant frequency of the modified resonators 150, 170 can be expressed as $$\omega = \frac{\tilde{W}_m + \tilde{W}_{eb}}{\tilde{W}_m + \tilde{W}_{ea}}\omega_0 - \frac{j\iint_s (\overline{H}\times\overline{E_0^*} + \overline{H_0^*}\times\overline{E})\cdot d\overline{s}}{\tilde{W}_m + \tilde{W}_{ea}} \tag{3}$$

where $$\tilde{W}_m = \iiint_V \mu\overline{H_0^*}\cdot\overline{H}dv$$

$$\tilde{W}_{ea} = \iiint_V \varepsilon(\overline{r})\overline{E}\cdot\overline{E_0^*}dv$$

$$\tilde{W}_{eb} = \iiint_V \varepsilon\overline{E_0^*}\cdot\overline{E}dv$$

which indicates that the resonant frequency is affected by the reaction between the field distributions of the original and the modified DR structures. It also implies that the resonant frequency can be more accurately predicted if the perturbed field can be approximated with reasonable accuracy. For example, if a small gap is carved off a DR, the electric field normal to the air-dielectric interface will be significantly enhanced, which can be observed by simulation.

Figure 2:
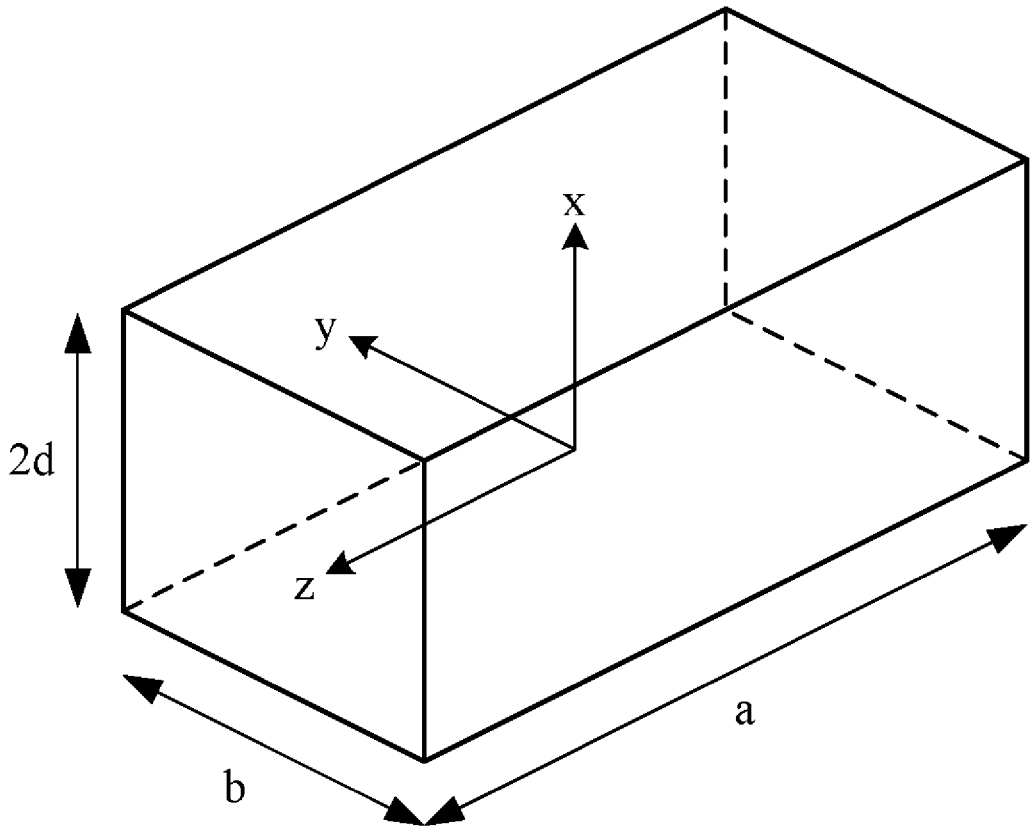

A DR of dimension d×b×a on an infinite ground plane can be viewed as a single block of rectangular dielectric with height **2*d* in free space, as shown in FIG. 2**. Since the permittivity of DR is much higher than that of the air, the air-dielectric interface can be approximated as a perfect magnetic conductor (PMC) wall in a first-order analysis, and the modes can be categorized into TE and TM modes. It is shown that the PMC approximation gives more accurate results with the TM modes than with the TE modes. The dielectric waveguide model (DWM) is proposed to render more accurate prediction, in which the DR is treated as a portion of a dielectric waveguide truncated in the propagation direction. The PMC approximation is imposed on the guide surfaces, and total reflection is assumed in the propagation direction. By this way, the fields of the $TE_{11m}{}^y$ modes with odd m can be derived as $$\begin{aligned}
E_{0x} &= -k_x A\cos(k_x x)\cos(k_y y)\sin(k_z z) \\
E_{0y} &= 0 \\
E_{0z} &= k_x A\sin(k_x x)\cos(k_y y)\cos(k_z z) \\
H_{0x} &= \frac{k_x k_y}{j\omega\mu}A\sin(k_x x)\sin(k_y y)\cos(k_z z) \\
H_{0y} &= \frac{k_x^2 + k_z^2}{j\omega\mu}A\cos(k_x x)\cos(k_y y)\cos(k_z z) \\
H_{0z} &= \frac{k_z k_y}{j\omega\mu}A\cos(k_x x)\sin(k_y y)\sin(k_z z)
\end{aligned} \tag{4}$$

where A is an arbitrary constant, $k_x=\pi/2d$, $k_2=m\pi/a$, and $k_y$ is determined from [Y. M. M. Antar, D. Cheng, G. Seguin, B. Henry, and M. G. Keller, "Modified waveguide model (MWGM) for rectangular resonator antenna (DRA)," *Microwave Opt. Tech. Lett.*, vol. 19, no. 2pp. 158-160, October 1998.]

$$\frac{k_y b}{2} = \tan^{-1}\left(\frac{\sqrt{k_x^2 + k_z^2}}{k_y}\right) \tag{5}$$

The resonant frequency can thus be calculated as $$f_r = \frac{c}{\sqrt{\varepsilon_r}}\sqrt{k_x^2 + k_y^2 + k_z^2} \tag{6}$$

The field expressions of the $TE_{11n}{}^y$ modes with even n can be derived as $$\begin{aligned}
E_{0x} &= -k_x B\cos(k_x x)\cos(k_y y)\cos(k_z z) \\
E_{0y} &= 0 \\
E_{0z} &= k_x B\sin(k_x x)\cos(k_y y)\sin(k_z z) \\
H_{0x} &= \frac{k_x k_y}{j\omega\mu}B\sin(k_x x)\sin(k_y y)\cos(k_z z) \\
H_{0y} &= \frac{k_x^2 + k_z^2}{j\omega\mu}B\cos(k_x x)\cos(k_y y)\sin(k_z z) \\
H_{0z} &= \frac{k_z k_y}{j\omega\mu}B\cos(k_x x)\sin(k_y y)\cos(k_z z)
\end{aligned} \tag{7}$$

where B is an arbitrary constant, $k_x=\pi/2d$, $k_z=n\pi/a$, $k_y$ and the resonant frequency can be determined from (5) and (6), respectively.

Figure 3A:
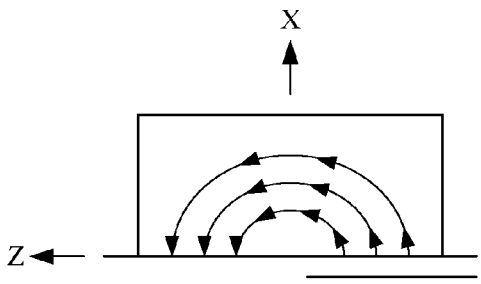
Figure 3B:
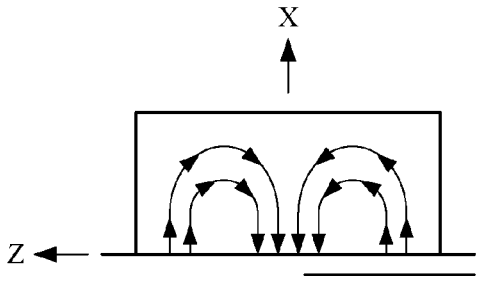
Figure 3C:
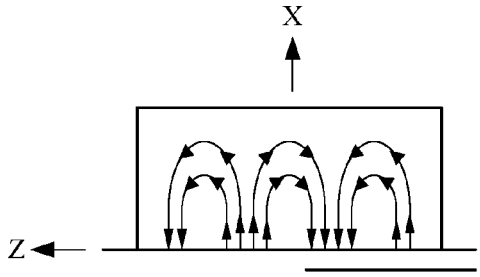

FIG. 3A, FIG. 3B and FIG. 3C illustrate the electric field distributions of the first three modes indexed by the third suffix, which indicates the number of variations of the electric field in the DR. The $E_z$ component along the z-axis has an odd number of variations for the odd modes, and has an even number of variations for the even modes. The $E_x$ component is anti-symmetric with respect to the x-axis for the odd modes, and is symmetric for the even modes.

Figure 4A:
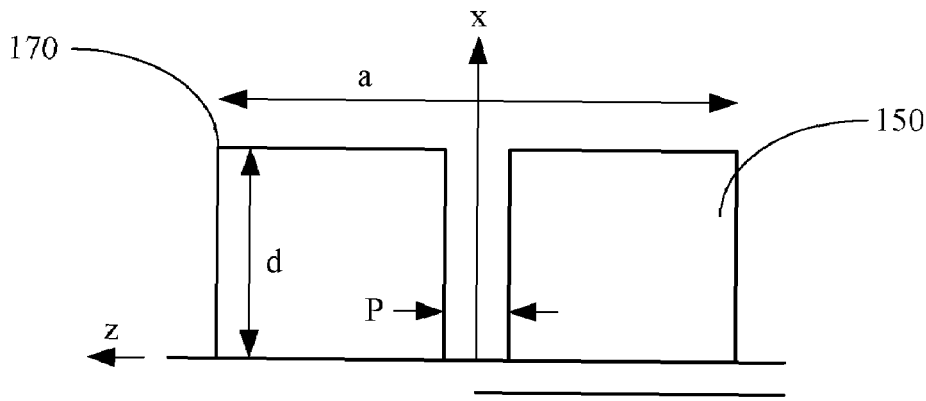

FIG. 4A shows two rectangular resonators 150, 170 placed on a ground plane, separated by a gap at z=0. At z=0, $E_z$ component of the $TE_{111}^y$ and $TE_{113}^y$ modes reaches the maximum while that of the $TE_{112}^y$ mode vanishes. The gap 142 p is much smaller than a, and the resonant modes associated with the single DR formed by filling the gap 142 between the aforementioned two DRs are excited. The air-dielectric interface of the gap 142 is normal to z, hence the $E_z$ component is significantly enhanced to satisfy the continuity condition on $D_z$.

Figure 5:
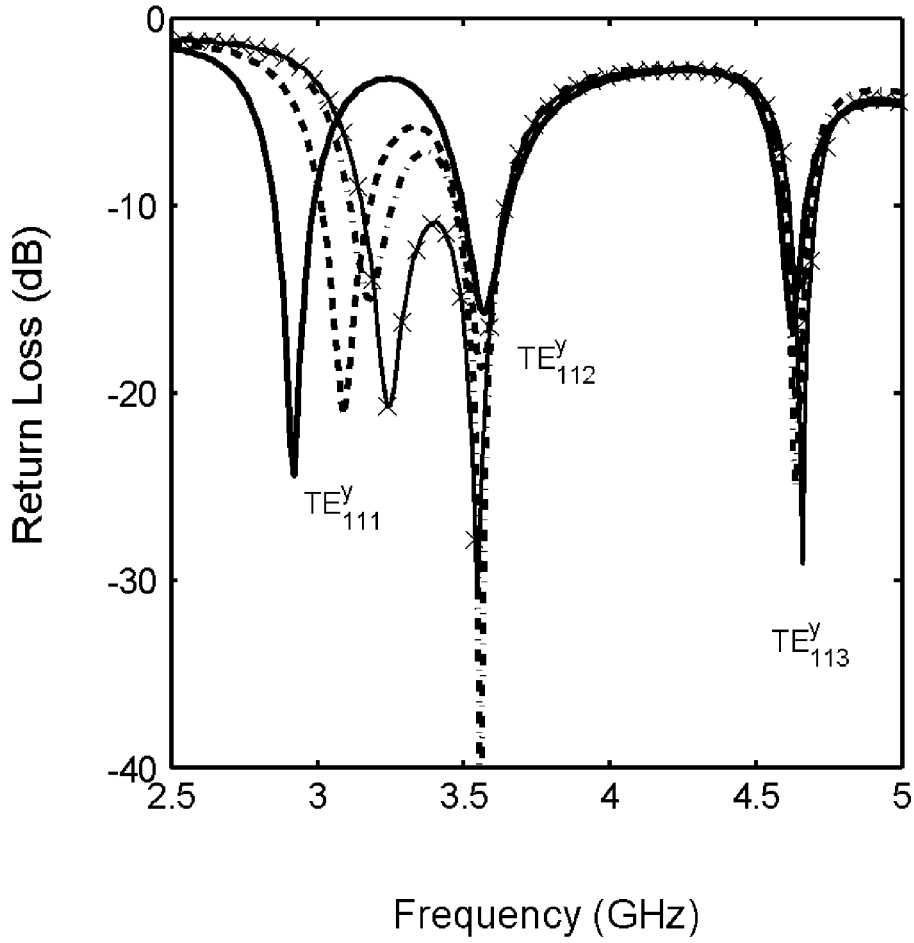
FIG. 5, FIG. 7, FIG. 9, and FIG. 10 are diagrams depict the relation between the return loss and the frequency.

FIG. 5 shows the effect gap 142 width p on the return loss, with a=28 mm, b=9 mm, d=10 mm, $\epsilon_r=20$, $\omega_a=2$ mm, $L_a=10$ mm, $L_s=8$ mm, $d_s=7$ mm, $W_gL_6==70$ mm, t=0.6 mm, $\omega_m=1.15$ mm and p=0~0.5 mm. It is observed that the resonant frequency of the $TE_{111}^y$ mode increases significantly, while those of the $TE_{112}^y$ and $TE_{113}^y$ modes are slightly affected. Note that the band associated with the $TE_{111}^y$ mode merges with that of the $TE_{112}^y$ mode.

Figure 4B:
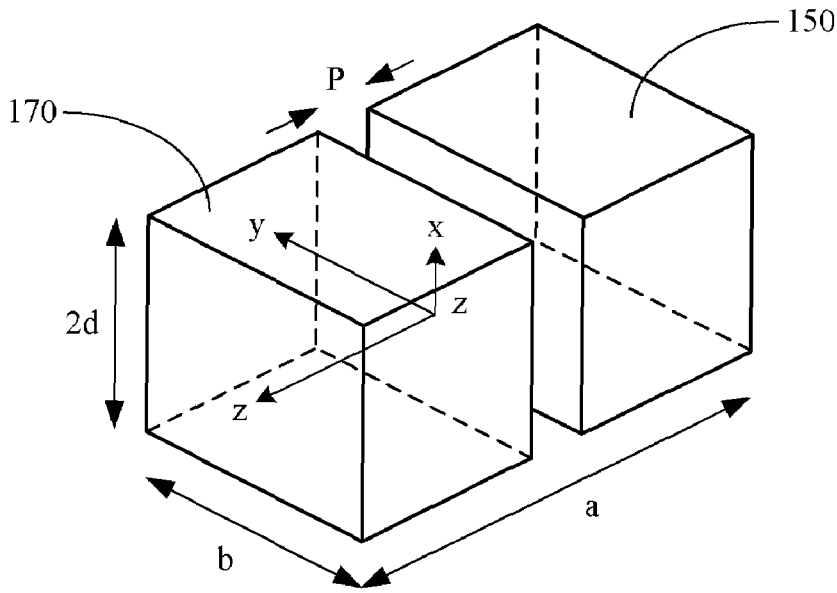

By image theory, the structure in FIG. 4A is equivalent to that in FIG. 4B if the ground plane is of infinite extent. The two resonators 150, 170 with a separating gap 142 can be regarded as an inhomogeneous DR with permittivity $\epsilon'(\vec{r})$. The gap 142 width p is assumed much smaller than a, hence the field distribution inside the single inhomogeneous DR 150, 170 is almost the same as that without the gap 142, except the normal electric field $E_z$ inside the gap 142 is enhanced to satisfy the air-dielectric continuity condition. Thus, the fields of the $TE_{111}^y$ and $TE_{113}^y$ modes in the air gap 142 can be approximated as $$E_z=m_1k_xA\sin(k_xx)\cos(k_yy)\cos(k_zp/2)$$

$$E_x=E_y\cong 0 \tag{8}$$

$$\tilde{H}=\tilde{H}_0$$

Note that the $E_z$ component is enhanced by a factor $m_1$. For the $TE_{111}^y$ mode, $m_1$ approaches $\epsilon_r$ as the gap 142 width is very small. For the $TE_{113}^y$ mode, it is observed that the $E_z$ component is only slightly enhanced, incurring a small $m_1$ of about 2 to 3. Hence, the resonant frequency of the $TE_{113}^y$ mode is slightly increased. In contrast, the fields of the $TE_{112}^y$ modes in the air gap 142 are approximately $$E_x=k_xB\cos(k_yy)\cos(k_xx)$$

$$E_z=E_y\cong 0 \tag{9}$$

$$\tilde{H}=\tilde{H}_0$$

Substituting (4), (8) with $k_z=\pi/a$ and $k_z=3\pi/a$, respectively, into (3), the resonant frequencies of the $TE_{111}^y$ and $TE_{113}^y$ modes can be estimated. Substituting (7), (9) with $k_z=2\pi/a$ into (3), the resonant frequency of the $TE_{112}^y$ mode can be estimated.

The radiation patterns can be determined from the tangential electric fields on the DR surfaces. Since the electric field distribution of the $TE_{112}^y$ mode, $E_z\propto\sin(2\pi z/a)$, has opposite directions on different portions of the DR top surface, a null in the $E_0$ pattern occurs in the $\hat{x}$-direction. The resonant frequencies of the $TE_{111}^y$ and $TE_{112}^y$ modes move closer as p is increased, and the two bands are merged at p=0.5 mm. However, due to the difference of radiation pattern, it is preferred to separate the band associated with the $TE_{112}^y$ mode from that with the $TE_{111}^y$ mode.

Figure 6A:
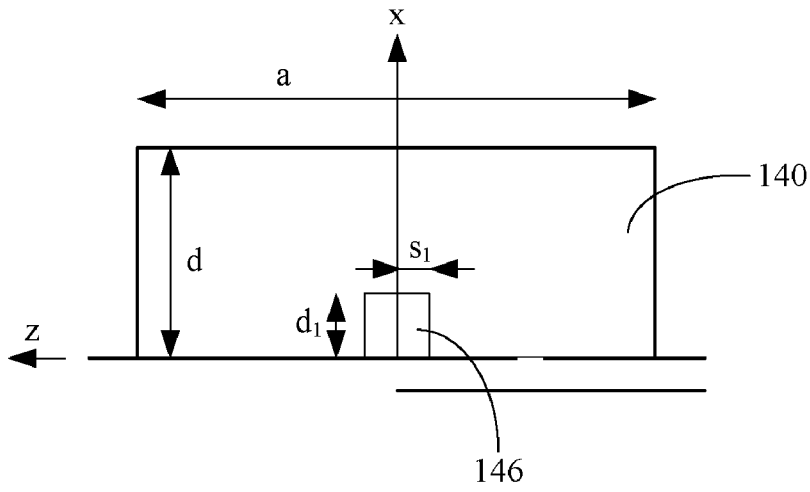
Figure 7:
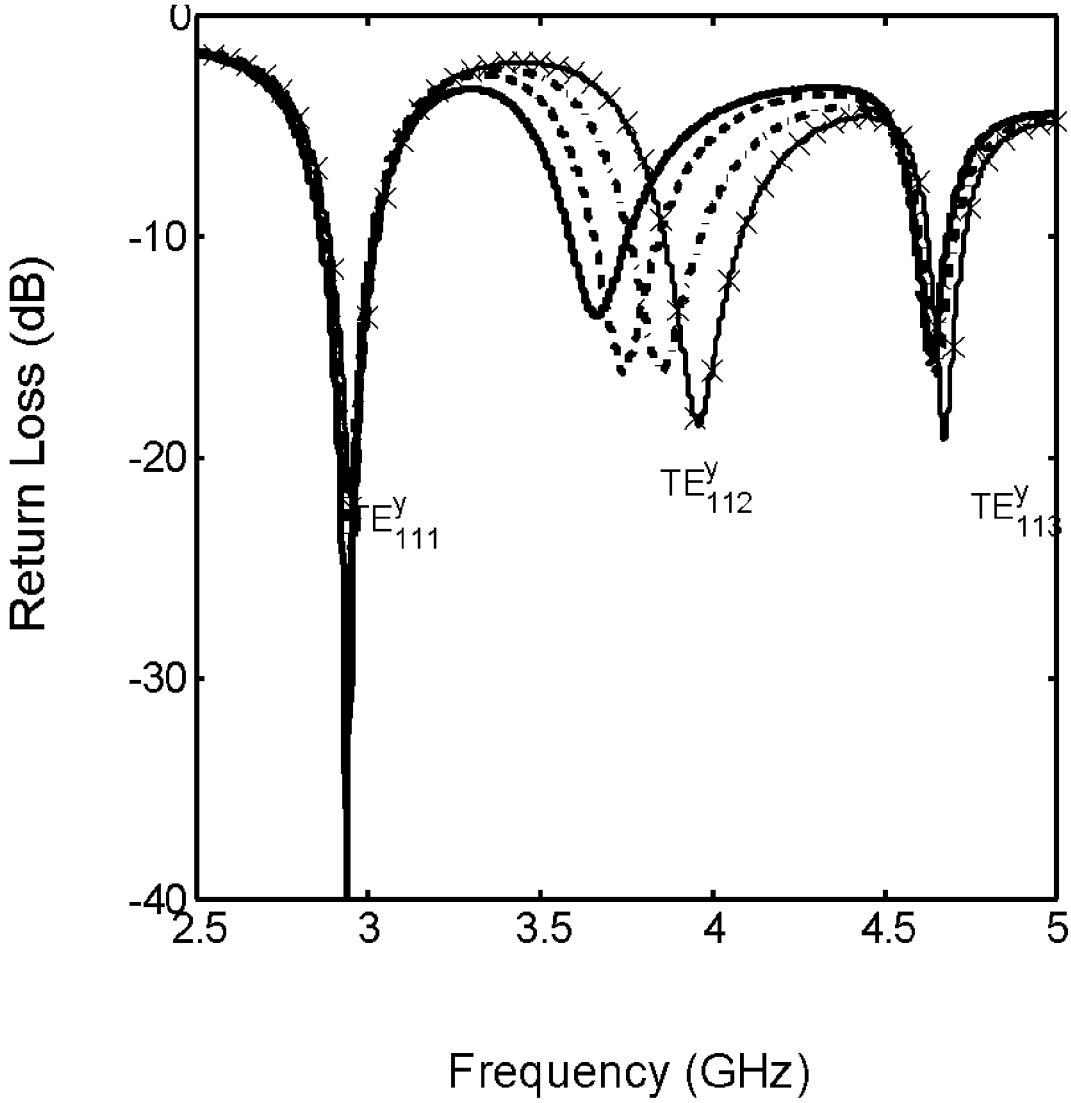

Based on (3), the resonant frequency of the $TE_{112}^y$ mode can be shifted away from that of the $TE_{111}^y$ mode if an air tunnel 146 is engraved at where the electric field of the $TE_{112}^y$ mode is strong while that of the $TE_{111}^y$ mode is negligible. As shown in FIG. 6A, an air tunnel 146 is engraved at the center bottom of a resonator structure 140 with the dimensions of $d_1\times b\times 2s_1$. The effect of the tunnel 146 half-width $s_1$ is shown in FIG. 7, with a=28 mm, b=9 mm, d=10 mm, p=0 mm, $d_1=4$ mm, $\epsilon_r=20$, $L_a=10$ mm, $L_s=8$ mm, $d_s=7$ mm, $W_g=L_g=70$ mm, t=0.6 mm, $\omega_m=1.15$ mm and $s_1=0.5\sim2$ mm. The resonant frequency of the $TE_{112}^y$ mode is increased as $s_1$ and $d_1$ increase, while those of the $TE_{111}^y$ and $TE_{113}^y$ modes are almost unaffected since their electric field at the tunnel 146 is weak.

Figure 6B:
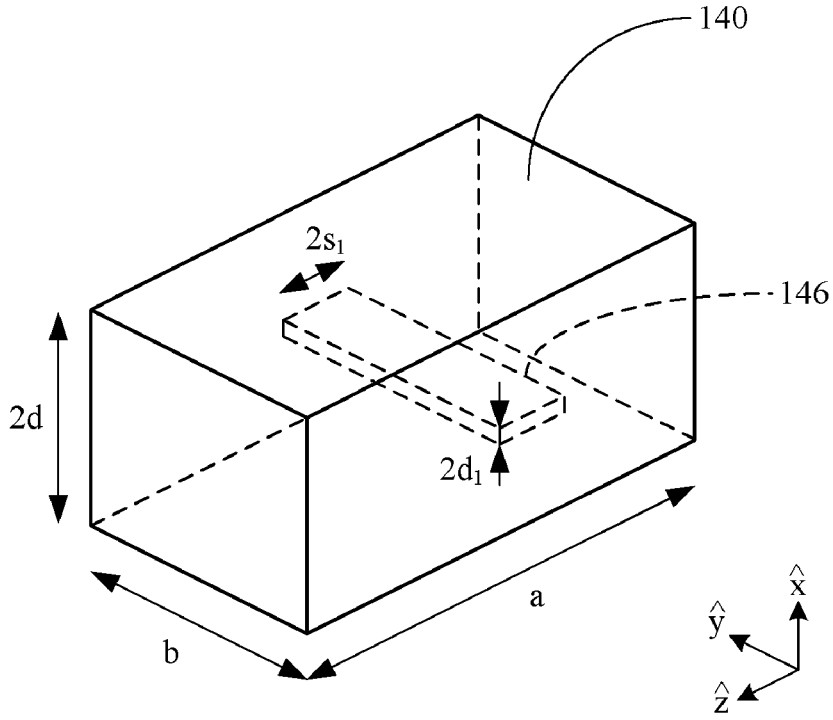

FIG. 6B shows an equivalent problem in free space by doubling the heights of the resonator structure 140 and the tunnel 146 using the image theory. Since the electric field of the $TE_{111}^y$ and the $TE_{113}^y$ modes rotates about the $\hat{y}$-axis, the field is tangential to the air-dielectric interface of the tunnel 146. Hence, it is reasonable to assume that $\tilde{E}\cong\tilde{E}_0$ and $\tilde{H}\cong\tilde{H}_0$.

As for the $TE_{112}^y$ mode, the tunnel 146 is located at where the electric field reaches the maximum. The $E_x$ component is enhanced in the tunnel 146, and can be approximated as $$E_x=k_zaB\cos(k_xd_1)\cos(k_yy)\cos(\beta z)$$

$$E_z=E_y\cong 0 \tag{10}$$

$$\tilde{H}=\tilde{H}_0$$

Substituting (7), (10) with $k_z=2\pi/a$ into (3), the resonant frequency shift of the $TE_{112}^y$ mode is predicted. The tunnel 146 has stronger effect on the resonant frequency of the $TE_{112}^y$ mode than that of the $TE_{111}^y$ and $TE_{113}^y$ modes. It is observed that the $E_x$ is strongly enhanced by a fold as the tunnel 146 is thin. The resonant frequency $f_r$ of the $TE_{112}^y$ mode is 3.646 GHz.

Figure 8A:
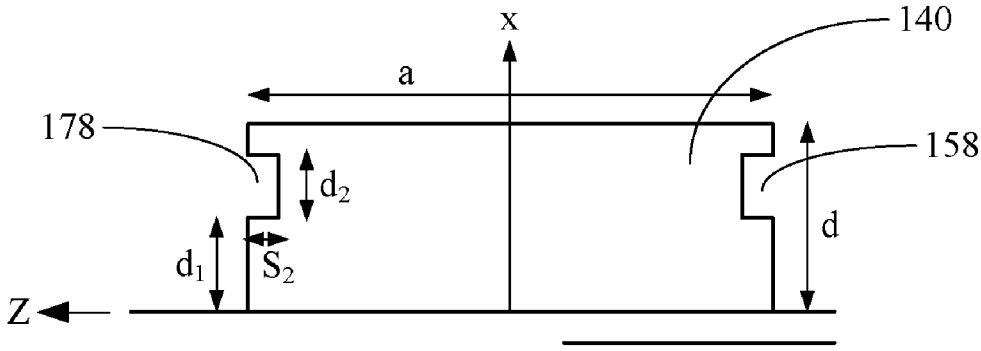
Figure 9:
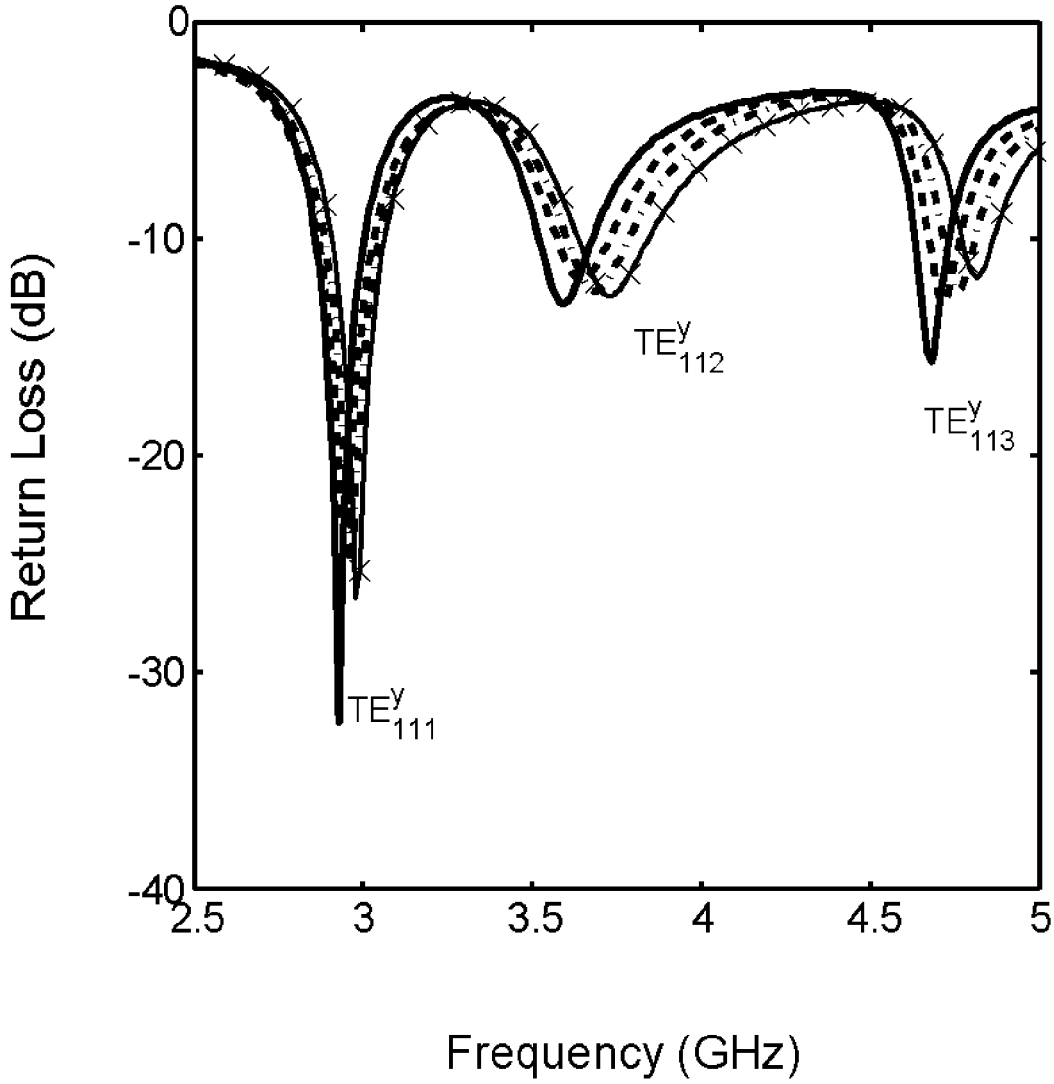

Since the $E_x$ component of the $TE_{111}^y$, $TE_{112}^y$ and $TE_{113}^y$ modes reaches maximum at z=±a/2, their resonant frequencies should be affected by notches 158, 178 near z=±a/2. FIG. 8A shows a grounded resonator structure 140 with two notches 158, 178 engraved around its edge. The notches 158, 178 will distort the electric field distribution, and the Q-factor of the resonator structure 140 will decrease, incurring a wider impedance bandwidth. FIG. 9 shows that the resonant frequencies of the three modes are increased by increasing the depth of notches 158, 178 $s_2$, with a=28 mm, b=9 mm, d=10 mm, $\epsilon_r=20$, $\omega_a=2$ mm, $L_a=10$ mm, $L_s=8$ mm, $d_s=7$ mm, $W_g=L_g=70$ mm, t=0.6 mm, $\omega_m=1.15$ mm and $s_2=0.5\sim2$ mm.

Figure 8B:
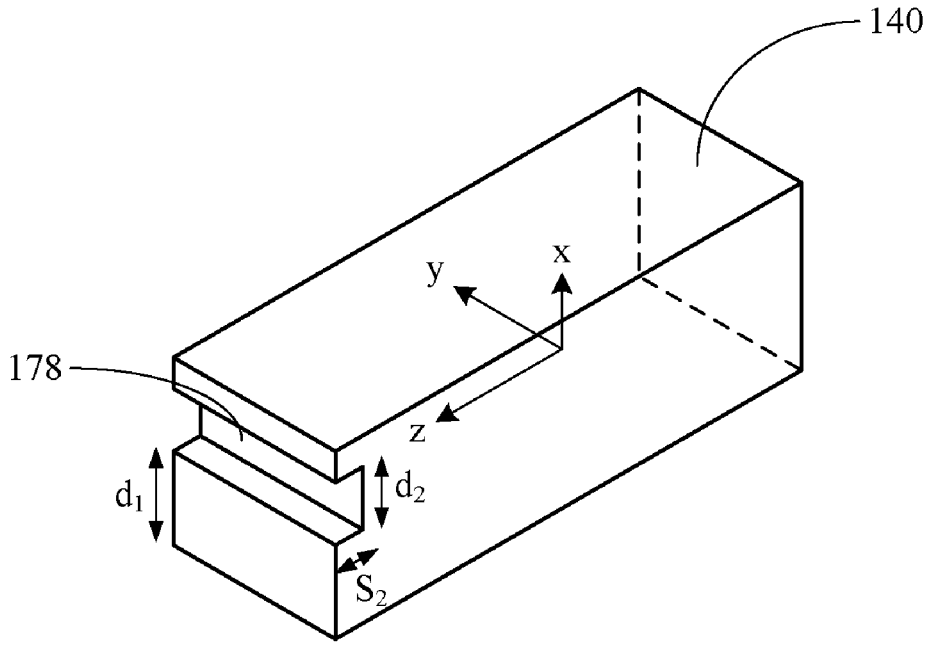

By image theory, the grounded resonator structure 140 with two notches 158, 178 is equivalent to an isolated DR with four notches on its edges. First consider only one notch, the second notch 178, of dimensions $d_2\times b\times s_2$ engraved off the resonator structure 140 in free space, as shown in FIG. 8B. The electric field within the second notch 178 is more complicated since both $E_x$ and $E_z$ components exist. The simulation shows that the $E_x$ component is stronger than the $E_z$ component. The $E_x$ component normal to the dielectric-air interface of the second notch 178 is enhanced to satisfy the continuity condition, and can be approximated as $$E_x=-k_z aB\cos(k_x d_1)\cos(k_y y)\cos(\beta z),$$

for $E_{111}^y$ and $TE_{113}^y$ modes (11)

$$E_x=m_2 k_z B\cos(k_x d_1)\cos(k_y y)\cos(k_z z),$$

for $TE_{112}^y$ mode (12)

With $d_2$=4 mm, $m_2$ is about 1.5. Substituting (4) and (11) into (3), the resonant frequencies of the DR with notches is obtained.

Figure 10:
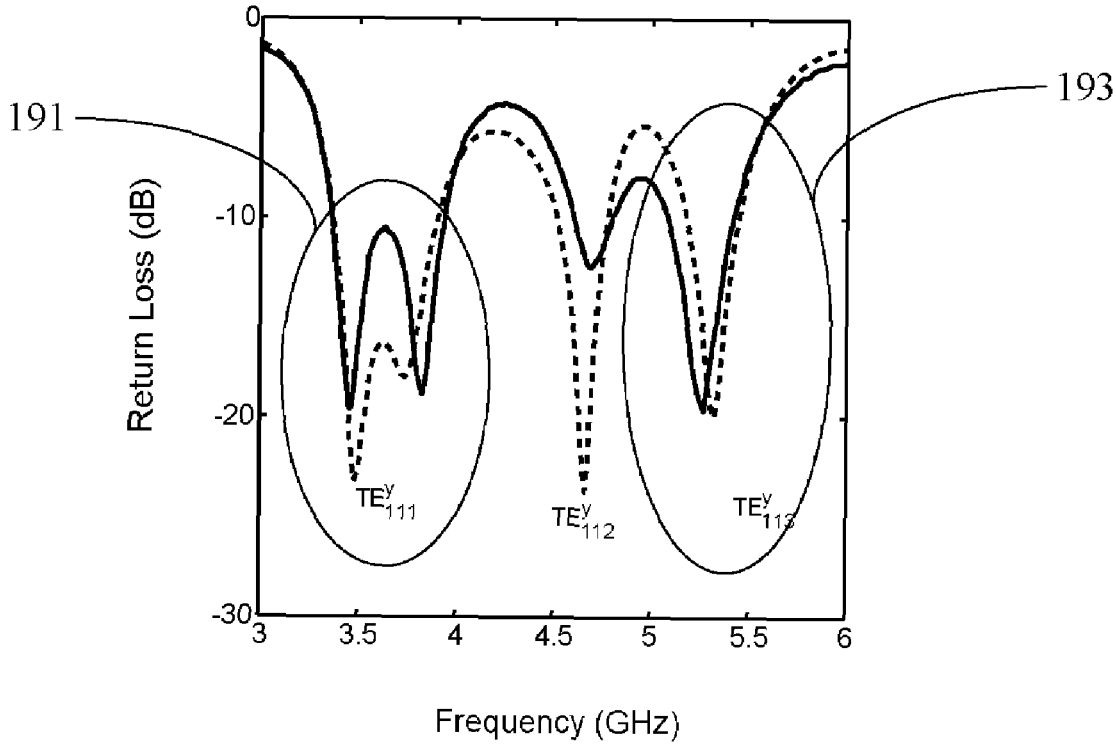

The design begins with a rectangular DR of dimension 10 mm×9 mm×29 mm, $d_s$=7 mm, $L_s$=8 mm, $W_a$=2 mm and $L_a$=10 mm. The resonant frequencies of the $TE_{111}^y$, $TE_{112}^y$, and $TE_{113}^y$ modes are 2.92 GHz, 3.58 GHz, and 4.62 GHz, respectively. In order to tune the resonant frequencies of the $TE_{111}^y$ and $TE_{113}^y$ modes to cover the WiMax (3.4-3.7 GHz) and the WLAN (5.15-5.35 GHz) bands, the resonator structure 140 is modified to the shape as shown in FIG. 1A, with p=1 mm, $d_1$=$d_2$=4 mm, and $s_1$=$s_2$=2 mm. The resonant frequencies of the three modes are shifted to 3.58 GHz, 4.3 GHz, and 5 GHz, respectively. By adjusting the offset $d_s$, the extended length of microstrip line 120 $L_s$, and the length of the aperture 132 $L_a$, the resonator structure 140 can be matched to 50Ω of the microstrip line feed 120, with the resonant frequencies slightly affected by the feeding structure. FIG. 10 shows the measured and simulated return loss, with a=28 mm, b=9 mm, d=10 mm, p=1 mm, $d_1$=4 mm, $s_1$=2 mm, $d_2$=4 mm, $s_2$=2 mm, $\epsilon_r$=20, h=4 mm, $\omega_a$=2 mm, $L_a$=10 mm, $L_s$=2.5 mm, $d_s$=4 mm, $W_g$=$L_g$=70 mm, t=0.6 mm and $\omega_m$=1.15 mm. There are three bands over 3.375-3.93 GHz (15%), 4.6-4.79 GHz (4%), and 5.08-5.415 GHz (6%), associated with the $TE_{111}^y$, $TE_{112}^y$, and $TE_{113}^y$ modes, respectively. The first band covers the WiMax (3.4-3.7 GHz), and the third band covers the WLAN (5.15-5.35 GHz).

Figure 11A:
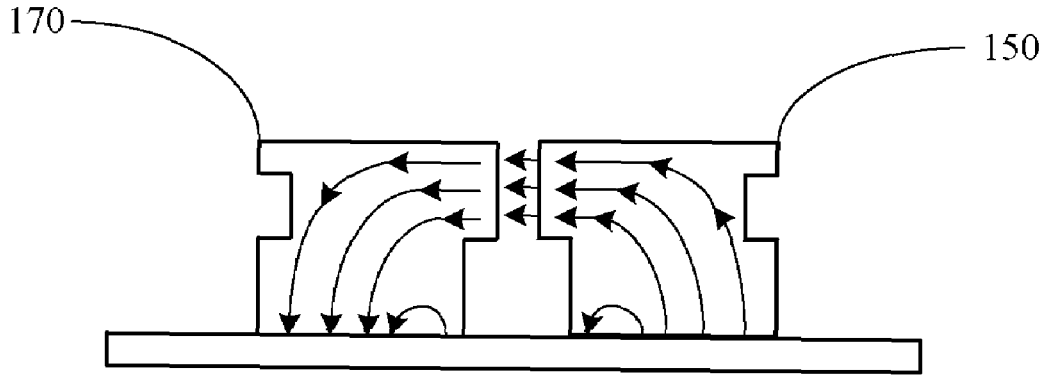
Figure 11B:
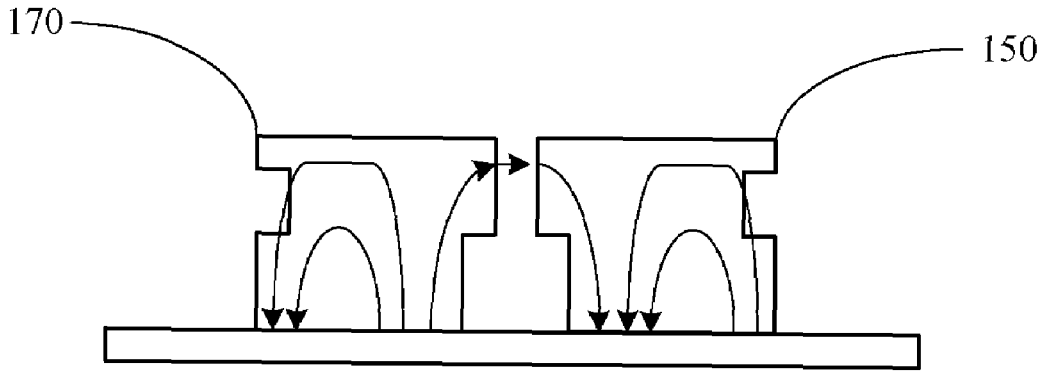

FIG. 11A and FIG. 11B show the electric field distributions over the first band 191 and the third band 193, respectively. The third resonant band 193 around f=5.265 GHz is associated with the $TE_{113}^y$ mode. The split resonator structure 150, 170 can be viewed as two radiators placed closely along the $\hat{z}$-direction.

The foregoing description is not intended to be exhaustive or to limit the invention to the precise forms disclosed. Hence, an antenna 100 disclosed in the present invention can comprise a substrate 110, a microstrip line 120, a ground plane 130 and a resonator structure 140. The microstrip line 120 and the ground plane 130 are formed on the opposite surfaces of the substrate 110, and the ground plane 130 comprises an aperture 132. The resonator structure 140 is placed on the ground plane 130, and a first resonator 150 and a second resonator 170 of the resonator structure 140 are separated by a gap 142.

Referring to FIG. 1A, the first resonator 150 comprises a first bottom surface 152 and a first side surface 154, and the second resonator 170 comprises a second bottom surface 172 and a second side surface 174, wherein the first bottom surface 152 and the ground plane 130 coincide, and the first bottom surface 152 overlaps the aperture 132. Moreover, the gap 142 can be a plate of air when the first resonator 150 and the second resonator 170 have an identical parallelepiped structure (such as rectangular solid) and are placed symmetrically. The resonator structure 140 can be a dielectric resonator structure fabricated by low-temperature cofired ceramic.

When radio signals are input via the microstrip line 120, radio signals can be coupled to the resonator structure 140 through the aperture 132. The electric field over the gap 142 is enhanced to radiate the radio signals more efficiently, reducing the Q-factor and increasing the bandwidth because the flux density at the interface between the dielectric resonator structure 140 and the air must be continuous, and the permittivity of the dielectric resonator structure 140 is much higher than that of the air. Hence, the width of the gap 142 can be adjusted to tune the resonant frequency of the $TE_{111}^y$ mode of the antenna 100 for covering the WiMax (3.3-3.7 GHz) and the WLAN (5.15-5.35 GHz) bands, as shown in FIG. 5.

Similarly, a first tunnel 156 can be engraved at the corner where the gap 142 and the first bottom surface 152 meet, and a second tunnel 176 can be engraved at the corner where the gap 142 and the second bottom surface 172 meet, as shown in FIG. 6A. The resonant frequency of the $TE_{112}^y$ mode of the antenna 100 can be tuned and the bandwidth of the $TE_{111}^y$ and $TE_{113}^y$ modes of the antenna 100 can be increased to cover the WLAN (5.15-5.35 GHz) band by adjusting the dimensions and the positions of the first tunnel 156 and the second tunnel 176, as shown in FIG. 7.

Figure 1C:
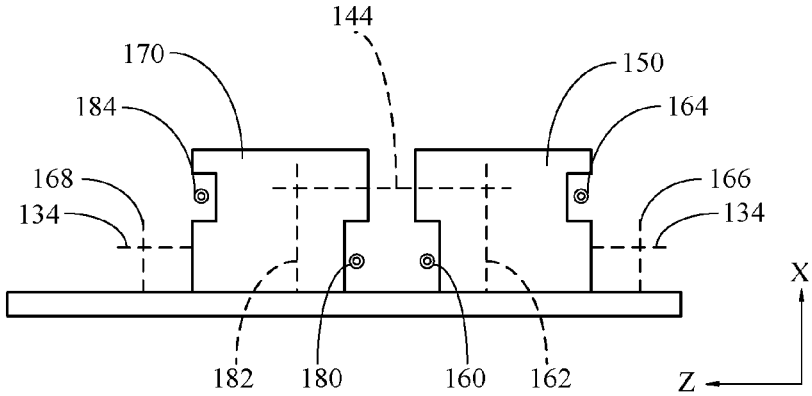

Referring FIG. 1C, the first tunnel 156 can pass through the first resonator 150 along a first bottom axis 160, the second tunnel 176 can pass through the second resonator 170 along a second bottom axis 180, wherein the first bottom axis 160 can be perpendicular to the normal 162 of the first bottom surface 152 and the normal 144 of the gap 142, and the second bottom axis 180 can be perpendicular to the normal 182 of the second bottom surface 172 and the normal 144 of the gap 142.

Referring FIG. 8, a first notch 158 can be engraved at the first side surface 154, and a second notch 178 can be engraved at the second side surface 174. The resonant frequencies of the $TE_{111}^y$, $TE_{112}^y$ and $TE_{113}^y$ modes of the antenna 100 can be fine tuned and the bandwidth of the $TE_{111}^y$, $TE_{112}^y$ and $TE_{113}^y$ modes of the antenna 100 can be increased by adjusting the dimensions and the positions of the first notch 158 and the second notch 178, as shown in FIG. 9.

Referring FIG. 1C, the first side surface 154 and the gap 142 are located on the opposite sides of the first resonator 150, and the first notch 158 passes through the first resonator 150 along a first side axis 164. The second side surface 174 and the gap 142 are located on the opposite sides of the second resonator 170, and the second notch 178 passes through the second resonator 170 along a second side axis 184 as well. The first side axis 164 can be perpendicular to the normal 166 of first side surface 154 and the normal 134 of the ground plane 130, and the second side axis 154 can be perpendicular to the normal 168 of the second side surface 174 and the normal 134 of the ground plane 130.

By combining the gap 142 with the first tunnel 156 and the second tunnel 176, the resonant frequencies of the $TE_{111}^y$ and $TE_{112}^y$ modes of the antenna 100 can be tuned, and the bandwidth of the $TE_{111}^y$ and $TE_{112}^y$ modes of the antenna 100 can be increased. By combining the gap 142 with the first tunnel 156, the second tunnel 176, the first notch 158 and the second notch 178, the resonant frequencies of the $TE_{111}^y$, $TE_{112}^y$ and $TE_{113}^y$ modes of the antenna 100 can be tuned, and the bandwidth of the $TE_{111}^y$, $TE_{112}^y$ and $TE_{113}^y$ modes of the antenna 100 can be increased. In addition, the resonant frequencies of the antenna 100 can be tuned by adjusting the dimensions of the resonator structure 140.

Referring to FIG. 1B, the first tunnel 156, a first notch 158, a second tunnel 176 and a second notch 178 can be rectangular. The microstrip line 120 extends along a first axis 122, and the aperture 132 extends along a second axis 136, wherein the orthogonal projection mapping of the first axis 122 to the substrate 110 can be perpendicular to the orthogonal projection mapping of the second axis 136 to the substrate 110. Furthermore, the orthogonal projection mapping of the first axis 122 to the substrate 110 can pass through the center of the orthogonal projection mapping of the second axis 136 to the substrate 110, the first bottom surface 152 and the second bottom surface 172. The antenna 100 further comprises a feed point and a ground point, wherein the feed point is located at one end of the microstrip line 120, and the ground point is located at the ground plane 130.

To cover the WiMAX and the WLAN bands, the resonant frequencies of the $TE_{111}^{y}$ and $TE_{113}^{y}$ modes of the antenna 100 are adjusted to cover 3.375-3.93 GHz and 5.08-5.415 GHz, with a=28 mm, b=9 mm, d=10 mm, p=1 mm, $d_1$=4 mm, $s_1$=2 mm, $d_2$=4 mm, $s_2$=2 mm, $\epsilon_r$=20, $\omega_a$=2 mm, $L_a$=10 mm, $L_s$=2.5 mm, $d_s$=4 mm, $W_g$=$L_g$=70 mm, t=0.6 mm and $\omega_m$=1.15 mm.

According to the above-mentioned, the electric field distributions vary with the resonant modes. Hence, the resonant frequencies of different modes can be adjusted to cover the required bandwidth or remove the non-applicable bandwidth due to notches and tunnels engraved at the resonator structure. Referring to FIG. 11, a resonant frequency tuning method for antenna is further disclosed for separately tuning the resonant frequencies of the resonator structure and increasing the bandwidth thereof, wherein the antenna can have a dielectric resonator structure fabricated by low-temperature cofired ceramic.

Figure 12:
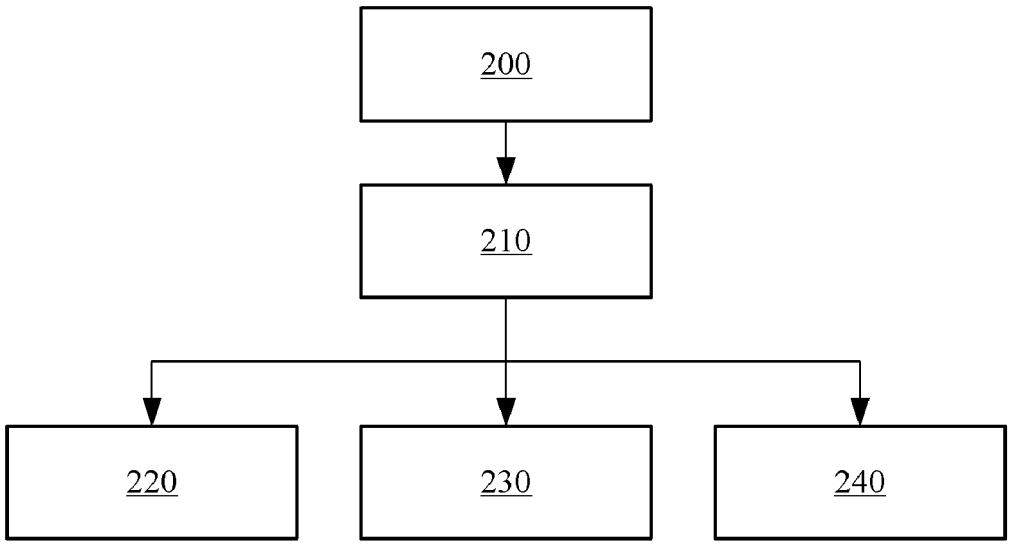
FIG. 12 is a diagram shows a flow chart of a resonant frequency tuning method of an antenna.

Referring to FIG. 12, the resonant frequency tuning method for antenna comprises the following steps. At first, the antenna 100 is provided, as shown in the step 200. In the step 210, the dimensions of the resonator structure 140 can be adjusted to tune the resonant frequencies of the antenna 100. The width of the gap 142 can be adjusted to tune the resonant frequency of the $TE_{111}^{y}$ mode of the antenna 100 and increase the bandwidth of the $TE_{111}^{y}$ mode of the antenna 100, as shown in the step 220. And the dimensions and the positions of the first tunnel 156 and the second tunnel 176 can be adjusted to tune the resonant frequency of the $TE_{112}^{y}$ mode of the antenna 100, as shown in the step 230. And the dimensions and the positions of the first notch 158 and the second notch 178 can be adjusted to increase the bandwidth of the $TE_{111}^{y}$, $TE_{112}^{y}$ and $TE_{113}^{y}$ modes, as shown in the step 240. Besides, other details can be applied as the foregoing embodiments and will not be further described.

The foregoing description is not intended to be exhaustive or to limit the invention to the precise forms disclosed. Obvious modifications or variations are possible in light of the above teachings. In this regard, the embodiment or embodiments discussed where chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the inventions as determined by the appended claims when interpreted in accordance with the breath to which they are fairly and legally entitled.

It is understood that several modifications, changes, and substitutions are intended in the foregoing disclosure and in some instances some features of the invention will be employed without a corresponding use of other features. Accordingly, it is appropriate that the appended claims be construed broadly and in a manner consistent with the scope of the invention.

The invention claimed is:

1. An antenna, comprising:

a substrate;

a microstrip line;

a ground plane, wherein said ground plane and said microstrip line are formed on the opposite surfaces of said substrate, and said ground plane comprises an aperture; and a resonator structure, placed on said ground plane, and a first resonator and a second resonator of said resonator structure are separated by a gap, wherein said microstrip line is used to feed said resonator structure through said aperture, and said first resonator comprises:

a first bottom surface, wherein said first bottom surface and said ground plane coincide, and a first tunnel is engraved at the corner where said gap and said first bottom surface meet; and said second resonator comprises:

a second bottom surface, wherein said second bottom surface and said ground plane coincide, and a second tunnel is engraved at the corner where said gap and said second bottom surface meet.

2. An antenna of claim 1, wherein said first and second resonator have an identical parallelepiped structure and are placed symmetrically.

3. An antenna of claim 2, wherein said first tunnel passes through said first resonator along a first bottom axis, and said second tunnel passes through said second resonator along a second bottom axis, wherein said first bottom axis is perpendicular to the normal of said first bottom surface and the normal of said gap, and said second bottom axis is perpendicular to the normal of said second bottom surface and the normal of said gap.

4. An antenna of claim 3, wherein said first and second tunnel are rectangular.

5. An antenna of claim 2, wherein said first resonator further comprises:

a first side surface, wherein said first side surface and said gap are located on the opposite sides of said first resonator, and a first notch is engraved at said first side surface; and said second resonator further comprises:

a second side surface, wherein said second side surface and said gap are located on the opposite sides of said second resonator, and a second notch is engraved at said second side surface.

6. An antenna of claim 5, wherein said first notch passes through said first resonator along a first side axis, and said second notch passes through said second resonator along a second side axis, wherein said first side axis is perpendicular to the normal of first side surface and the normal of said ground plane, and said second side axis is perpendicular to the normal of said second side surface and the normal of said ground plane.

7. An antenna of claim 6, wherein said first and second notch are rectangular.

8. An antenna of claim 1, wherein said first bottom surface overlaps said aperture.

9. An antenna of claim 1, wherein said resonator structure is a dielectric resonator structure fabricated by low-temperature co-fired ceramic.

10. An antenna of claim 1, wherein said microstrip line extends along a first axis, and said aperture extends along a second axis, wherein the orthogonal projection mapping of said first axis to said substrate is perpendicular to the orthogonal projection mapping of said second axis to said substrate.

11. An antenna of claim 10, wherein the orthogonal projection mapping of said first axis to said substrate passes through the center of the orthogonal projection mapping of said second axis to said substrate, said first bottom surface and said second bottom surface.

12. An antenna of claim 11, further comprising a feed point located at one end of said microstrip line and a ground point located at said ground plane.

13. A resonant frequency tuning method for antenna, comprising the steps of:

providing an antenna, comprising:

a substrate;

a microstrip line;

a ground plane, wherein said ground plane and said microstrip line are formed on the opposite surfaces of said substrate, and said ground plane comprises an aperture; and a resonator structure, placed on said ground plane, and a first resonator and a second resonator of said resonator structure are separated by a gap, wherein said microstrip line is used to feed said resonator structure through said aperture, and said first resonator comprises:

a first bottom surface, wherein said first bottom surface and said ground plane coincide, and a first tunnel is engraved at the corner where said gap and said first bottom surface meet; and said second resonator comprises:

a second bottom surface, wherein said second bottom surface and said ground plane coincide, and a second tunnel is engraved at the corner where said gap and said second bottom surface meet, adjusting the dimensions of said resonator structure to tune the resonant frequencies of said antenna;

adjusting the width of said gap to tune the resonant frequency of the $TE_{111}^{y}$ mode of said antenna and increasing the bandwidth of the $TE_{111}^{y}$ mode of said antenna; and adjusting the dimensions and the positions of said first and second tunnel to tune the resonant frequency of the $TE_{112}^{y}$ mode of said antenna.

14. A resonant frequency tuning method for antenna of claim 13, wherein said first and second resonators have an identical parallelepiped structure and are placed symmetrically.

15. A resonant frequency tuning method for antenna of claim 14, wherein said first tunnel passes through said first resonator along a first bottom axis, and said second tunnel passes through said second resonator along a second bottom axis, wherein said first bottom axis is perpendicular to the normal of said first bottom surface and the normal of said gap, and said second bottom axis is perpendicular to the normal of said second bottom surface and the normal of said gap.

16. A resonant frequency tuning method for antenna of claim 15, wherein said first and second tunnels are rectangular.

17. A resonant frequency tuning method for antenna of claim 14, further comprising the steps of:

adjusting the dimensions and the positions of a first notch and a second notch to increase the bandwidth of the $TE_{111}^{y}$, $TE_{112}^{y}$ and $TE_{113}^{y}$ modes of said antenna, and said first and second notch are separately engraved at a first side surface and a second side surface, wherein said first side surface and said gap are located on the opposite sides of said first resonator, and said second side surface and said gap are located on the opposite sides of said second resonator.

18. A resonant frequency tuning method for antenna of claim 17, wherein said first notch passes through said first resonator along a first side axis, and said second notch passes through said second resonator along a second side axis, wherein said first side axis is perpendicular to the normal of first side surface and the normal of said ground plane, and said second side axis is perpendicular to the normal of said second side surface and the normal of said ground plane.

19. A resonant frequency tuning method for antenna of claim 18, wherein said first and second notches are rectangular.

20. A resonant frequency tuning method for antenna of claim 13, wherein said first bottom surface overlaps said aperture.

21. A resonant frequency tuning method for antenna of claim 13, wherein said resonator structure is a dielectric resonator structure fabricated by low-temperature co-fired ceramic.

22. A resonant frequency tuning method for antenna of claim 13, wherein said microstrip line extends along a first axis, and said aperture extends along a second axis, wherein the orthogonal projection mapping of said first axis to said substrate is perpendicular to the orthogonal projection mapping of said second axis to said substrate.

23. A resonant frequency tuning method for antenna of claim 22, wherein the orthogonal projection mapping of said first axis to said substrate passes through the center of the orthogonal projection mapping of said second axis to said substrate, said first bottom surface and said second bottom surface.

24. A resonant frequency tuning method for antenna of claim 13, further comprising a feed point located at one end of said microstrip line and a ground point located at said ground plane.

* * * * *